US006342666B1

(12) United States Patent
Shutoh

(10) Patent No.: US 6,342,666 B1
(45) Date of Patent: Jan. 29, 2002

(54) MULTI-TERMINAL MIDI INTERFACE UNIT FOR ELECTRONIC MUSIC SYSTEM

(75) Inventor: Kazuhiko Shutoh, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/579,572

(22) Filed: May 26, 2000

(30) Foreign Application Priority Data

Oct. 6, 1999 (JP) ..... 11-164379

(51) Int. Cl.[7] ..... G10H 7/00
(52) U.S. Cl. ..... 84/645; 84/477 R
(58) Field of Search ..... 84/645, 477 R, 84/478

(56) References Cited

U.S. PATENT DOCUMENTS 4,899,632 A 2/1990 Okamura
5,121,491 A * 6/1992 Sloan et al. ..... 84/645 X
5,296,641 A * 3/1994 Stelzel ..... 84/645 X
5,389,729 A * 2/1995 Hiramatsu ..... 84/645 X
5,576,507 A * 11/1996 LaMarra ..... 84/645
5,652,400 A * 7/1997 Fujimori et al. ..... 84/645 X
5,675,100 A * 10/1997 Hewlett ..... 84/645 X
6,121,536 A * 9/2000 Malcolm ..... 84/645

FOREIGN PATENT DOCUMENTS

JP 6-295269 10/1994

* cited by examiner

*Primary Examiner*—Stanley J. Witkowski
(74) *Attorney, Agent, or Firm*—Morrison & Foerster LLP

(57) ABSTRACT

The interface unit has not only MIDI input terminals 11-1~11-n and MIDI output terminals 12-1~12-n through which MIDI data can be inputted and outputted according to MIDI transmission protocol respectively, but new terminals such as USB terminal 13, TO HOST terminal 14 through which MIDI data can be sent and received according to different protocols from MIDI transmission protocol such as USB transmission protocol, TO HOST transmission protocol. The PC unit 31 controls the input and/or output data transmission of the system, by designating relationship of data transmission between any two connected units in the system.

11 Claims, 12 Drawing Sheets

MULTI-TERMINAL MIDI INTERFACE UNIT FOR ELECTRONIC MUSIC SYSTEM

BACKGROUND OF THE INVENTION

1. Field of the Invention

The present invention relates to an interface unit in electronic music systems that contains MIDI input terminals (input means) and MIDI output terminals (output means) through which MIDI data can be respectively inputted and outputted under the enacted MIDI transmission protocol, and to data storage medium which stores programs to be read out by a machine (computer) for functioning said interface unit.

2. Description of the Related Art

To control the function of a musical sound generation system, MIDI data exchange under MIDI transmission protocol has been widely employed in order to define generation timing of a musical note, its pitch, its timbre, its intensity, its modulation effect etc. Note that "MIDI" stands for Musical Instrument Digital Interface. This MIDI transmission protocol treats only unidirectional serial data transmission in relatively lower speed, and the number of channels, namely musical parts in ensemble music, that can be treated in one line is limited to sixteen (16). Therefore, an interface unit comprising eight (8) input means, eight (8) output means, and eight (8) "through" means, connected directly to the input means to output the inputted signal without any modification, have been in ordinary usage in most of the system in which said MIDI data are sent and received.

Recently with the increase of number of notes which can be generated in chorus from a musical sound generator, the number of channels which can be treated in one generator is becoming more than sixteen (16). This channel number increase requires the system more advanced function and capability to manage a larger number of parameters. As to computer connection capability, in addition to said MIDI input means and MIDI output means, a bi-directional (reciprocative) input and/or output (hereinafter written "input/output") means which functions under so-called "TO HOST" transmission protocol (hereinafter called "TO HOST input/output means") has recently been introduced in new types of interface unit. Furthermore, still more advanced interface units are gradually becoming popular replacing "TO HOST input/output means" by "USB" or "IEEE1394" (hereinafter called "USB input/output means" and "IEEE input/output means") which are bi-directional input/output means of greater speed than "TO HOST input/output means".

In any of the above-described existing interface units, only one of the three means, namely, USB input/output means, IEEE input/output means and TO HOST input/output means is equipped, in addition to MIDI input means and MIDI output means. Therefore, it is possible to input/output a large quantity of data through one of the three means, however, it is impossible to provide the interface unit with another MIDI input means and MIDI output means for an equally large quantity of data, especially because the MIDI input means and the MIDI output means require physical space of the interface unit for their connecting terminals.

For this reason, it was impossible with the existing interface units to extract full capability of a large electronic music system by transmitting efficiently much data each other among the connected units, especially when many electronic music units having only MIDI input/output means, other units having both MIDI input/output means and other input/output means using other transmission protocol than MIDI transmission protocol such as TO HOST input/output means, are connected in the whole system. The present invention is to resolve the above-said inefficiency found in relatively big electronic music systems.

SUMMARY OF THE INVENTION

It is therefore a primary object of the present invention to provide an interface unit which makes ample use of a large number of electronic music units by transmitting a large quantity of data among the units. The invented system can produce richer music by exchanging much information quantity, since it can adopt not only music units having only MIDI input means and MIDI output means, but also music units having, in addition to MIDI input means and MIDI output means, different input/output means working under different transmission protocol from MIDI transmission protocol such as TO HOST input/output means.

More specifically, it is an object of the present invention to provide an interface unit (system), for inputting and outputting data, comprising MIDI input terminals through which MIDI data can be inputted under MIDI transmission protocol, MIDI output terminals through which MIDI data can be outputted under MIDI transmission protocol, first terminal through which MIDI data can be inputted and outputted under first transmission protocol different from MIDI transmission protocol, second terminal through which MIDI data can be inputted and outputted under transmission protocol different from both MIDI transmission protocol and said first transmission protocol. In this system, a processor, connected to said MIDI input terminals, said MIDI output terminals, said first terminal, and said second terminal, is adapted to input and output data through said terminals.

In the invented system described above, in case a big quantity of data are inputted not only by MIDI input terminals (or MIDI input means) from various music units such as electronic musical instruments, sequencers, sound generation units etc. but by the first input/output terminals (the first input/output means) from other units such as computers, musical instruments, it is possible to output data, not only to various music units by MIDI output means, but by the second input/output terminals (the second input/output means), to other units such as interface units, various music units, computers, and moreover to still other various music units, computers etc. connected in succeeding signal transmission stream. This results in enabling the system to generate richer music by making ample use of a large number of electronic music units with efficient transmission of a big quantity of data among the units in the system.

It is another object of this invention to provide said interface unit, wherein said processor is adapted to input and output data through said terminals in accordance with relationship of inputting and outputting among said MIDI input terminals, said MIDI output terminals, said first terminal, and said second terminal. The relationship is defined by conditions, which can be altered to determine which terminal, said MIDI input terminals, said MIDI output terminals, said first terminal, or said second terminal, should be selected to output the data inputted through said terminals. The interface unit is connected to another processor which is adapted to determine said conditions.

The processor in the interface unit functions in accordance with the input/output conditions set by a user's preference to select one terminal out of MIDI output terminals, said first input/output terminals, and said second input/output terminals, to output the data inputted via anyone among the MIDI input terminals, said first input/output terminals, and said second input/output terminals. This makes it possible to achieve freer data transmission via this new interface system, resulting in making maximal use of a large number of connected music units.

According to one aspect of the above-described invention, the data are transmitted through said first and said second terminals under different transmission protocols each other. More specifically, the data are transmitted through said first terminal under USB transmission protocol and through said second terminals under TO HOST transmission protocol.

With this aspect, it is possible to utilize not only (A)the input/output terminals for data inputting/outputting under certain transmission protocols used in ordinary computers (for ex. USB transmission protocol), but (B)the input/output terminals for data inputting/outputting under certain transmission protocols used in existing electronic music units (for ex., TO HOST transmission protocol). This enables the user to transmit the data for a large number of existing music units and to easily manipulate the data for various music units.

It is another object of this invention to provide a method for controlling inputting and outputting data through an interface unit, having MIDI input terminals, MIDI output terminals, first and second terminals, comprising a step of determining relationship of inputting and outputting among said MIDI input terminals, said MIDI output terminals, said first terminal and said second terminal, in accordance with the conditions, which can be altered to determine which terminal, said MIDI input terminals, said MIDI output terminals, said first terminal, or said second terminal, should be selected to output the data inputted through said terminals, and a step of inputting MIDI data through said MIDI input terminals under MIDI transmission protocol, outputting MIDI data through said MIDI output terminals under MIDI transmission protocol, inputting or outputting MIDI data through said first terminal under first transmission protocol different from MIDI transmission protocol, and inputting or outputting MIDI data through said second terminal under second transmission protocol different from both MIDI transmission protocol and said first transmission protocol.

According to another aspect of the above-described invention, said first transmission protocol is different from said second transmission protocol. More specifically, said first transmission protocol is USB transmission protocol, and said second transmission protocol is TO HOST transmission protocol.

It is another aspect of the above-described invention, said determining step further comprises a step of displaying editing image showing input terminals along with one axis and output terminals along with the other axis perpendicular to said axis, and a step of displaying relationship of said input terminals and said output terminals designated (by the user) on said editing image.

It is another object of this invention to provide a machine readable medium containing instructions for causing said machine to perform a method for controlling inputting and outputting MIDI data through an interface unit having MIDI input terminals through which MIDI data can be outputted under MIDI transmission protocol, first terminal through which MIDI data can be inputted and outputted under transmission protocol different from MIDI transmission protocol, and second terminal through which data can be inputted and outputted under transmission protocol different from both MIDI transmission protocol and said first transmission protocol, said method comprising determining relationship of inputting and outputting among said MIDI input terminals, said MIDI output terminals, said first terminal, and said second terminal, in accordance with conditions, which can be altered to determine which terminal, said MIDI input terminals, said MIDI output terminals, said first terminal, or said second terminal, should be selected to output the data inputted through said terminals.

By storing program including said instructions in a machine, such as a PC unit connected to this interface unit, the interface unit itself, or various music units having this interface unit, it becomes possible to designate easily various input/output conditions of data transmission among MIDI input terminals, MIDI output terminals, and the first and the second input/output terminals. In such a case, said determining step further comprising the steps of displaying editing image showing input terminals along with one axis and output terminals along with the other axis perpendicular to said axis, and displaying relationship of said input terminals and said output terminals designated on said editing image.

BRIEF DESCRIPTION OF THE DRAWINGS

Other objects and advantages of the present invention will be readily understood by those skilled in the art from the following description of preferred embodiments of the present invention in conjunction with the accompanying drawings of which.

DETAILED DESCRIPTION OF THE PREFERRED EMBODIMENTS

Figure 1:
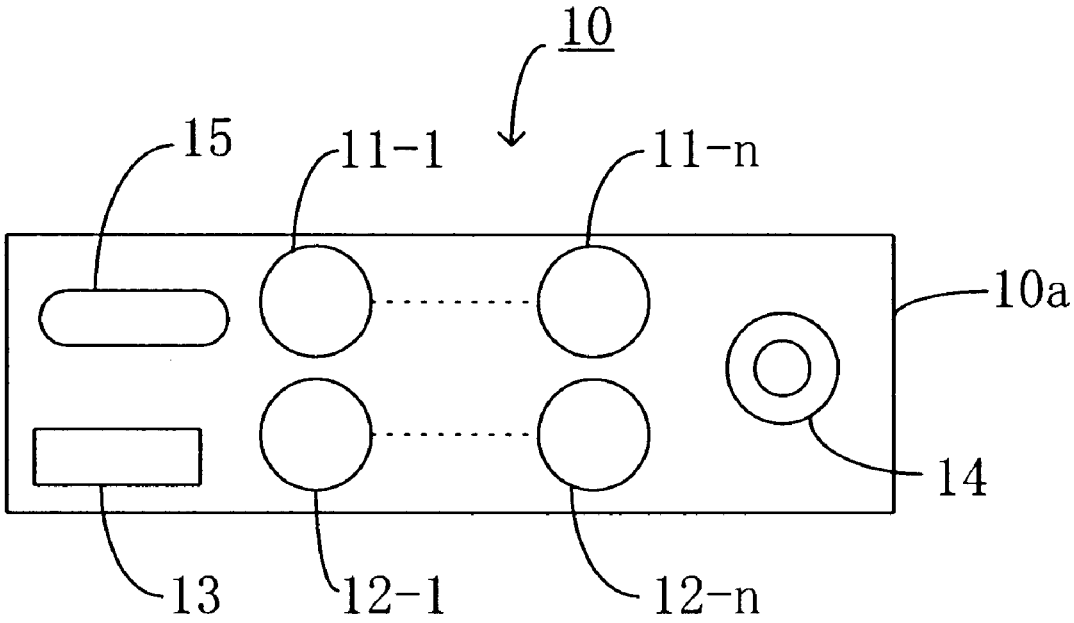
FIG. 1 is showing one aspect of an interface unit as an embodiment of the present invention.

Preferred embodiment of the present invention will now be described with referring to the accompanying drawings. FIG. 1 shows an aspect of the casing 10*a* of the interface unit 10 relating to the present invention.

In the casing 10*a* there are a plural number of MIDI input terminals 11-1~11-n ("n" may be 8, for ex.) and MIDI output terminals 12-1~12-n, USB terminal 13 and TO HOST terminal 14 as well as the power supplying terminal 15 to supply electric power to every circuit in the interface unit 10. It should be noted that "TO HOST terminal" is a serial port of inputting and outputting interface based on the rules used in so-called RS-232C port or RS-422 port. The MIDI input terminals 11-1~11-n are connection terminals for data inputting according to MIDI transmission protocol, to which one end of MIDI cable is connected. The MIDI output terminals 12-1~12-n are connection terminals for data outputting according to MIDI transmission protocol, to which one end of MIDI cable is connected. The USB terminal 13 is the terminal for data inputting and outputting according to USB transmission protocol, to which one end of USB cable is connected. The TO HOST terminal 14 is terminal for data inputting and outputting according to TO HOST transmission protocol, to which one end of TO HOST cable is connected.

MIDI transmission protocol is an enacted transmission rule to transmit serial data uni-directionally and its transmission rate is 31.25 Kbps, which is relatively lower. USB transmission protocol is also an enacted transmission rule to transmit serial data bi-directionally and its transmission rate is 12 Mbps, which is relatively high. TO HOST transmission protocol is another enacted transmission rule to transmit serial data bi-directionally and its transmission rate is 38.4 Kbps, which is relatively low-middle.

Figure 2:
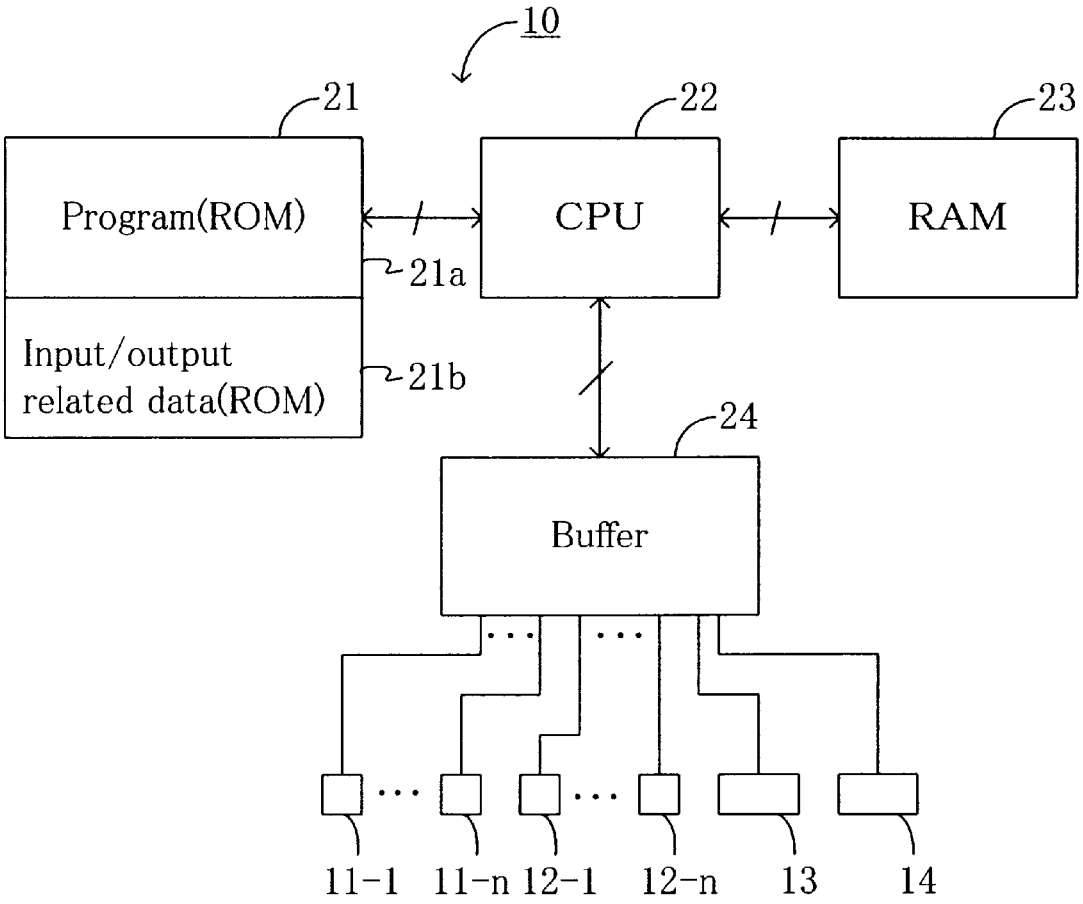
FIG. 2 is a block diagram of the micro-computer circuit integrated in the interface unit.

In the case 10*a*, as shown in FIG. 2, there are a microcomputer circuit comprising ROM 21, CPU 22, RAM 23 and Buffer 24. The ROM 21 is divided into a program area 21*a* and an input/output related data area 21*b*.

Figure 3:
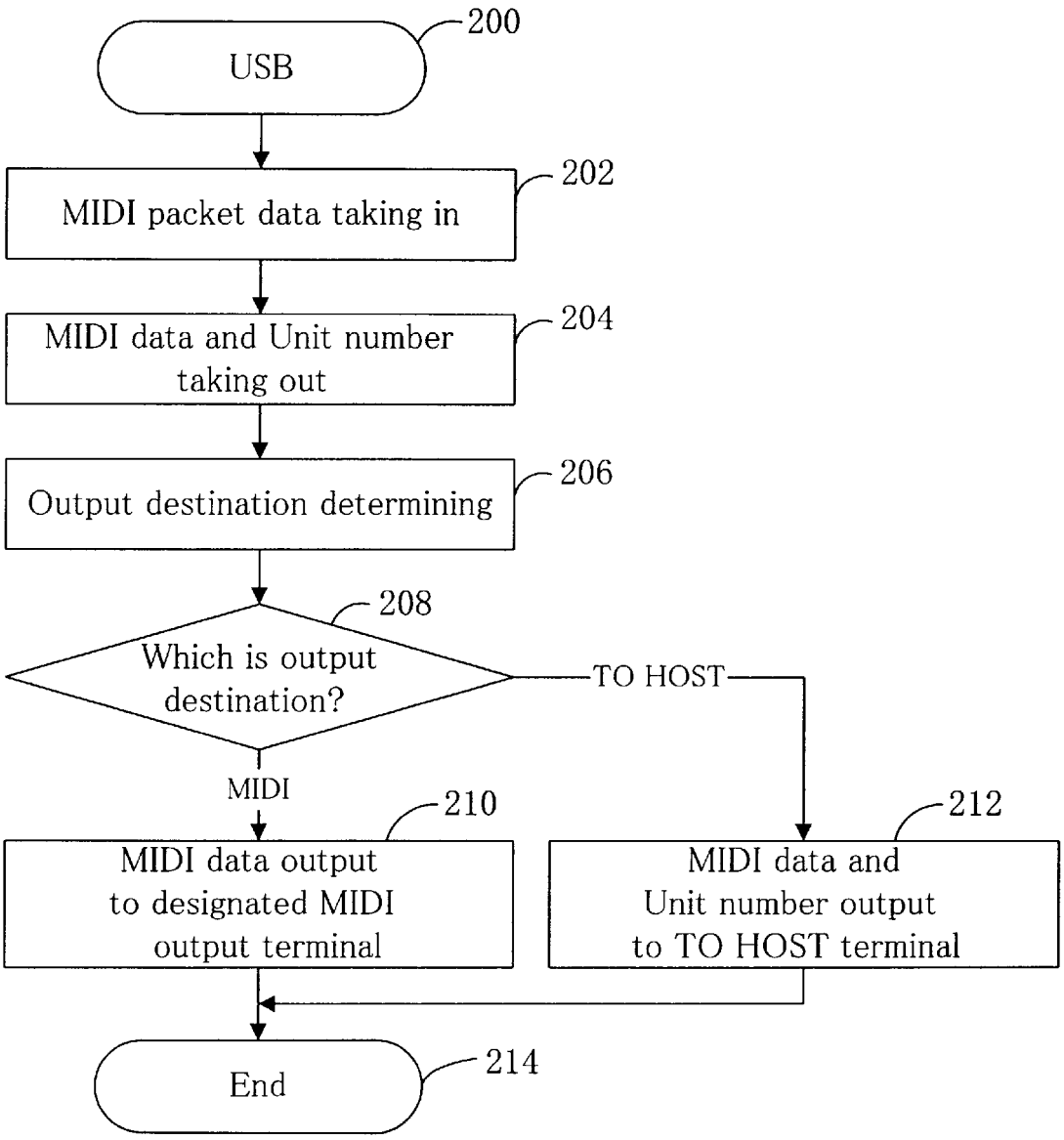
FIG. 3 is a flow chart of USB program exercised in the interface unit.
Figure 4:
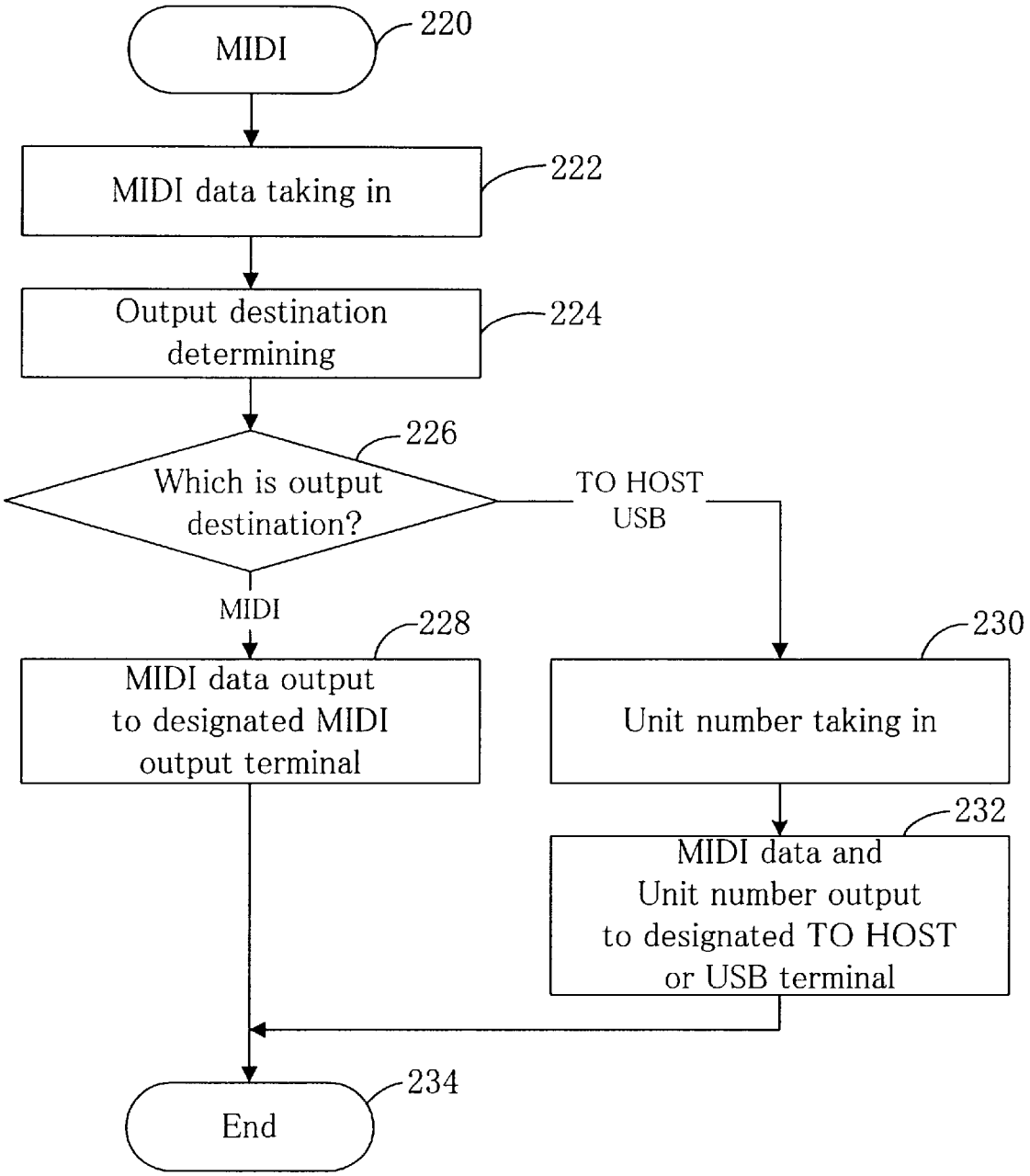
FIG. 4 is a flow chart of MIDI program exercised in the interface unit.
Figure 5:
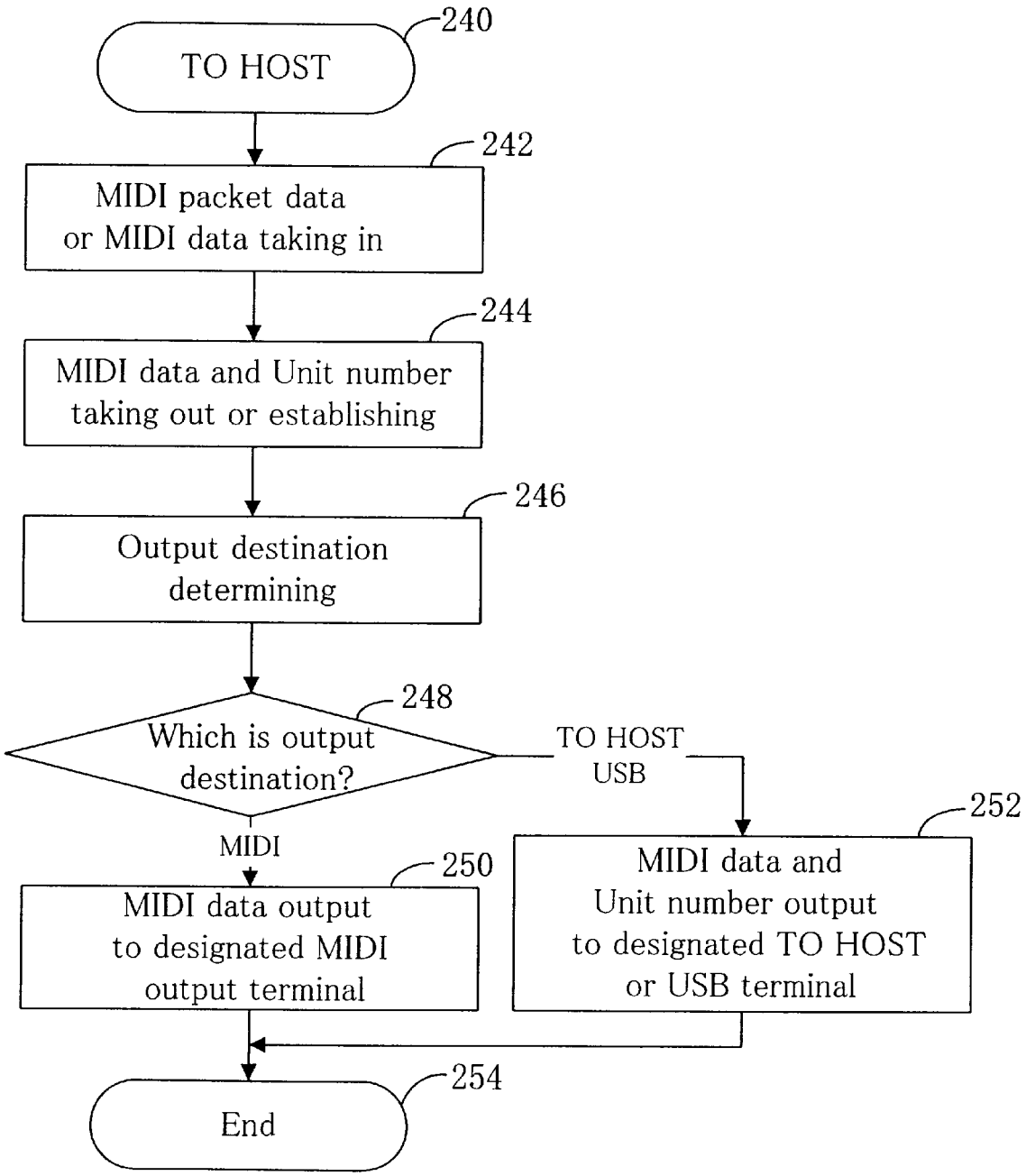
FIG. 5 is flow chart of TO HOST program exercised in the interface unit.

In the program area 21*a*, programs shown in FIGS. 3–5 which designate the proper output terminals among MIDI output terminals 12-1~12-n, USB terminal 13 and TO HOST terminal 14 for the inputted data from MIDI input terminal 11-1~11-n, USB terminal 13 TO HOST terminal 14 are integrated. And also, other programs are there integrated such as to designate the proper start-up program among the programs shown in FIGS. 3–5 when data are inputted through MIDI input terminals 11-1~11-n, USB terminal 13 and/or TO HOST terminal 14, and as to read out and/or write in the data of the input/output related data area 21*b* according to designation from exterior unit.

Figure 6:
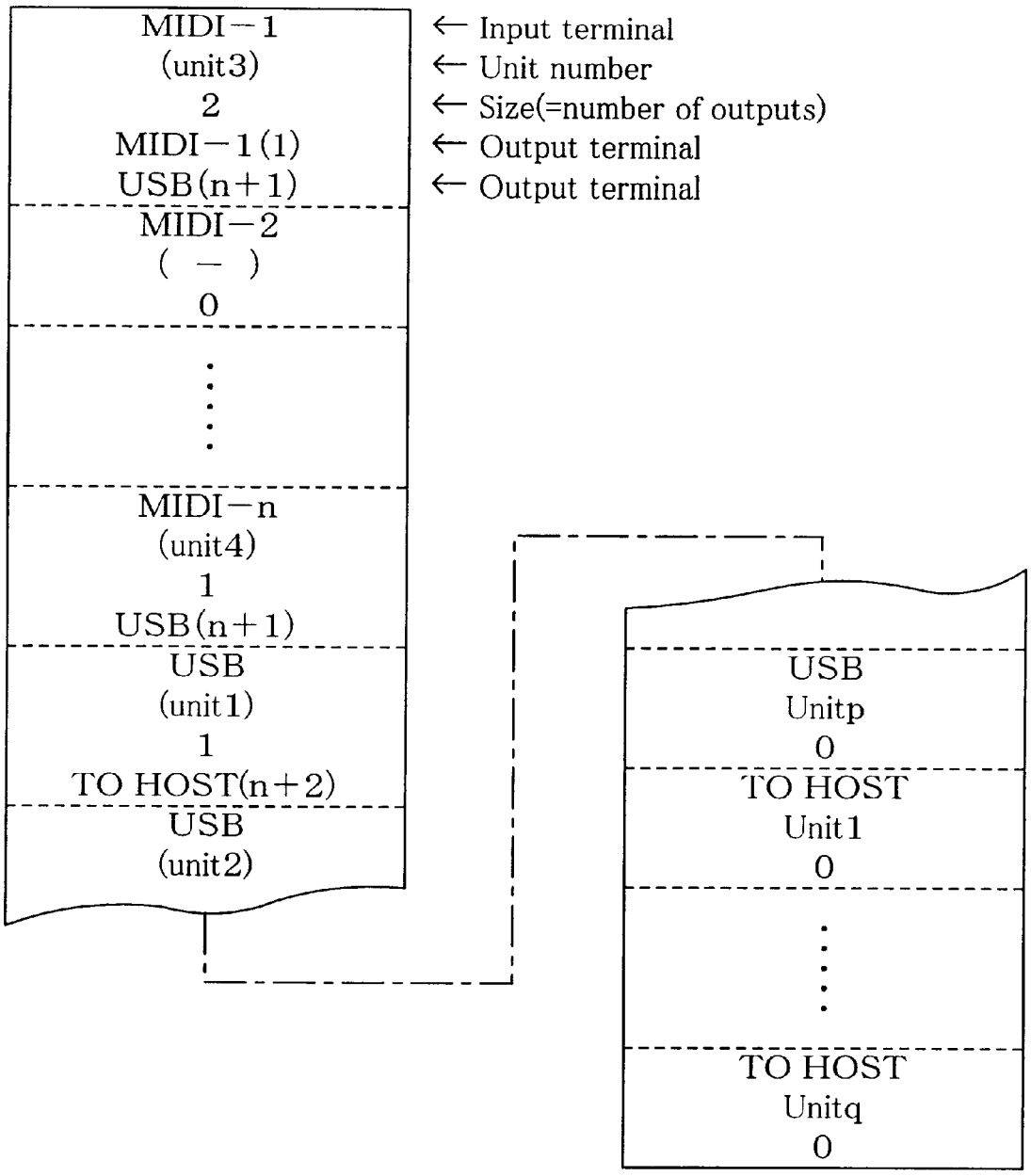
FIG. 6 shows a format diagram of the data stored in the input/output data area of FIG. 2.

The input/output related data area 21*b*, as shown in FIG. 6, stores plural data sets, one set consisting of input terminal data, unit number data, size data (=number of output terminal data), and output terminal data, for each one of input terminals (if the input terminal is USB terminal 13 or TO HOST terminal 14, for each one of the numbers of unit). The input terminal data designates one of the terminals among MIDI input terminals 11-1~11-n, USB terminal 13, and TO HOST terminal 14, to work as data inputting terminal. The unit number data signify the number of the unit to which the data are to be transmitted. The size data signify the number of output terminals from which the data are to be outputted. The output terminal data designates one of the terminals among MIDI output terminals 12-1~12-n, USB terminal 13, and TO HOST terminal 14, to work as outputting terminal of said inputted data. The number of such stored output terminal data is the same with the number signified by the size data. Thus, if the size data, namely the number of the output terminals, show zero "0", such output terminal data do not exist. The input/output related data area 21*b*, at least, should be implemented with writable ROM, although it is also recommendable to construct the whole ROM 21 with writable ROM. It is also possible in the implementation to replace said writable ROM as a whole or only said input/output related data area 21*b* with non-volatile RAM.

The CPU 22 executes said programs and the RAM 23 stores temporarily data for executing the programs. The buffer 24 is connected to MIDI input terminals 11-1~11-n, MIDI output terminals 12-1~12-n, USB terminal 13 and TO HOST terminal 14, transfers the data supplied to MIDI input terminals 11-1~11-n, USB terminal 13 and TO HOST terminal 14 to the CPU 22, and transfers the data supplied from the CPU 22 to MIDI output terminals 12-1~12-n, USB terminal 13 and TO HOST terminal 14, according to the indication from the CPU 22.

Figure 7:
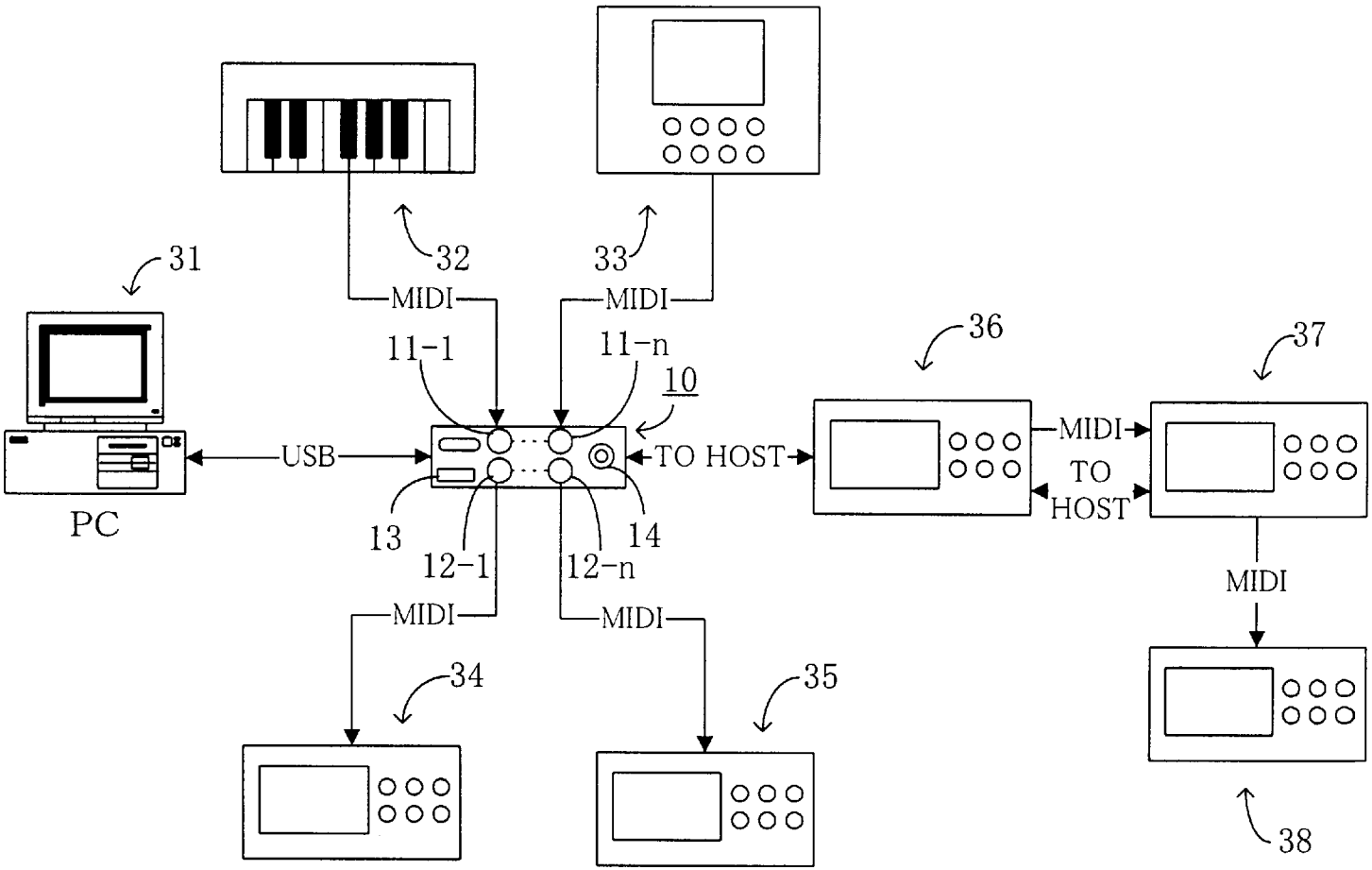
FIG. 7 is a block diagram of an example of musical instrument performance system using the interface unit.

The following explains how the above-described interface unit functions with citing the music performance system in which the interface unit is used. FIG. 7 shows an example of music performance system. The interface unit 10 has the USB terminal 13 which, via USB cable, is connected to a PC unit 31 comprising computer (processor), keyboard, mouse controller, display unit etc. This computer, including a hard disk storage, reads out data and programs stored in exterior medium such as compact disk (CD), flexible disk etc., and writes data and programs in said exterior medium.

The MIDI input terminals 11-1~11-n of the interface unit 10 are connected with music units such as electronic musical instrument 32, sequencer 33, via MIDI cable. The electronic musical instrument 32, having input devices for performance such as music keyboard, outputs control data (hereinafter called "MIDI data") to control generation timing of a musical note, its pitch, its timbre, its intensity, its modulation effect etc. under MIDI transmission protocol responding to operation of the performance devices. The sequencer 33 outputs sequentially and automatically MIDI data under MIDI transmission protocol. Music units such as sound generation units 34, 35 etc. are connected to the MIDI output terminals 12-1~12-n of the interface unit 10, via MIDI cable. The sound generation units 34, 35 are equipped with sound generation circuit to generate musical sound signals, and the circuit establishes and outputs musical sound signals in accordance with the inputted MIDI data A sound generation unit 36 is connected to the TO HOST terminal of the interface unit 10 via TO HOST cable. This sound generation unit 36 is provided not only with MIDI input terminal, MIDI output terminal and said TO HOST terminal, but another TO HOST terminal, at least. Thus, the sound generation unit 36, executing the program in FIG. 8, responding to the MIDI data inputted via the TO HOST terminal, establishes (generates) and outputs musical sound signals, like said sound generation units 34, 35, and/or transmits MIDI data to succeeding sound generation units 37, 38 via the other TO HOST terminals.

Figure 9:
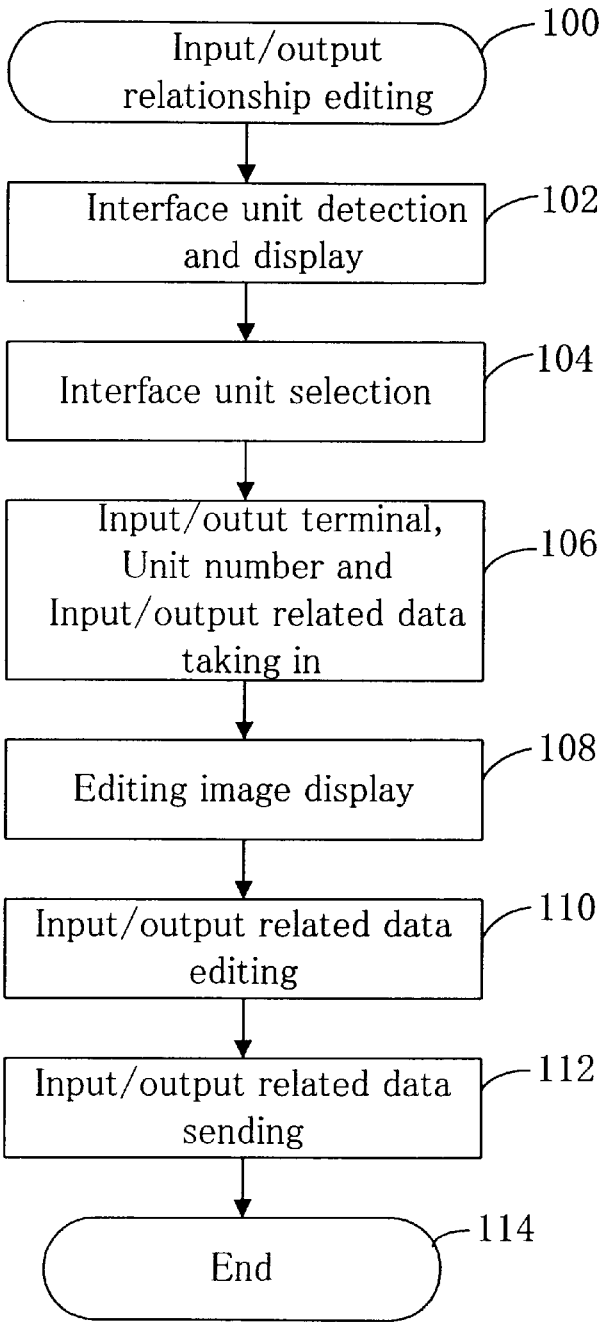
FIG. 9 is a flow chart of a program exercised in the PC of FIG. 7, in order to edit input/output relationship.

When operating the above-described music performance system, users are required to set exterior (external) storage media such as flexible disk, compact disk storing "input/output related editing program" comprising instructions shown in FIG. 9 in the PC unit 31 firstly, so that the program can be written in hard disk, RAM etc. of the PC unit 31 (a machine) to be read out and exercised. It is also possible to prepare beforehand said "input/output related editing program" in the hard disk.

When operated by the user with operational devices like computer-keyboard, the "input/output related editing program" is started up in the PC unit 31. This program begins to start at the step 100, then the PC unit 31 detects, at the step 102, all the interface units in which input/output relationship can be designated and which are connected to the lower stream of the USB terminal in the PC unit 31, and displays all said interface units detected. At the next step 104, the PC unit 31 selects the interface unit to edit among all the detected interface units. To practice this, the user designates one interface unit among all the interface units in the display screen, meaning that the designated interface unit is selected as the interface unit to edit. In the following description, it is assumed that the interface unit 10 is the one selected.

After having executed the said step 104, the PC unit 31, at the step 106, outputs signal to the interface unit 10 to request inputting data from the unit 10 via USB cable and obtains data, the data expressing all the terminals of the interface unit 10, identifying the number of units acceptable by each terminal as to the terminals, among all the terminals, which can output MIDI data to plural units (for example, USB terminal, or TO HOST terminal), and the data group indicating input and output relationship of the terminals, the data group stored in the input/output related data area 21*b* of the interface unit 10. The requested data are sent via the USB cable. Note that the data expressing all said terminals and number of units are stored in advance in the interface unit 10.

Figure 10:
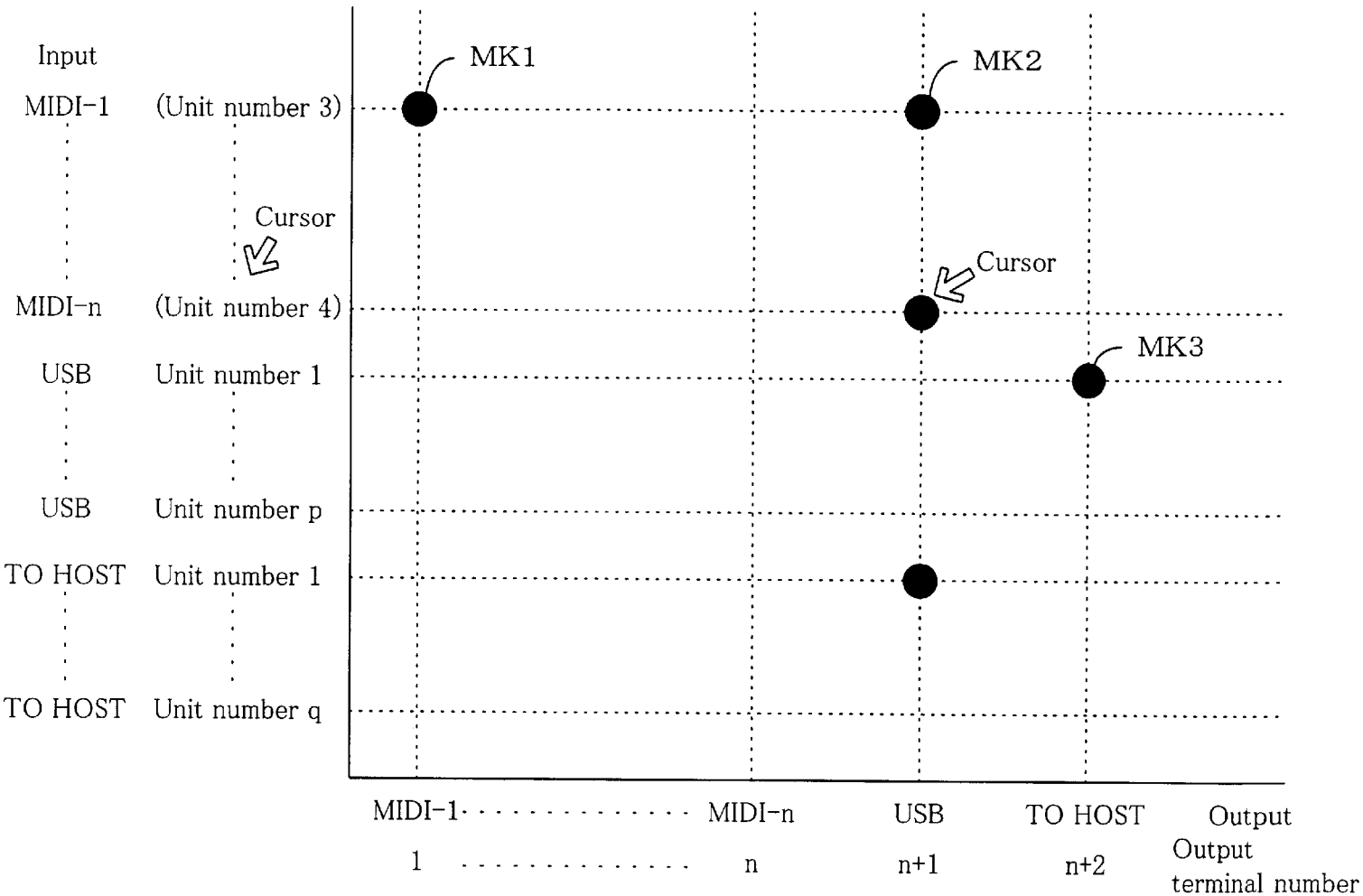
FIG. 10 is an example of a editing screen displayed in the PC of FIG. 7.

Next, the PC unit 31 displays on its screen, at the step 108, a graphic image for editing input/output related data based on the inputted data from said interface unit 10. In this image, based on the data identifying each terminal used for said data input and identifying the number of each unit acceptable by each terminal, each terminal of the input as well as the number of each unit acceptable by each terminal is displayed along Y axis, while broken lines in parallel with X axis is also displayed corresponding to said each terminal and the number of each unit. In addition, each terminal for output is displayed along X axis and broken lines corresponding to the each terminal for output are shown in parallel with Y axis. Putting it more concretely, as seen in FIG. 10, n MIDI terminals 11-1~11-n of the interface unit 10, USB terminal 13 and numbers of p units 1-p acceptable by said USB terminal 13, and TO HOST terminal 14 and numbers of q units 1-q acceptable by said TO HOST terminal 14 are displayed along Y axis, while n MIDI output terminals 12-1~12-n (corresponding to numbers of output 1–n), USB terminal 13 (corresponding to the number of output, n+1) and TO HOST terminal 14 (corresponding to the number of output, n+2) are displayed along Y axis.

In said editing image on the screen, based on the inputted input/output related data group, black circled marks MK are shown in order to point out the input/output data correspondence at each intersection of the broken lines in parallel with X axis or Y axis. Namely, when the data inputted from MIDI input terminals 11-1 are outputted from MIDI output terminal 12-1 and USB terminal 13, the marks MK1 and MK2 appear on the intersections of "MIDI-1 and MIDI-1" (output number: 1) and "MIDI-1 and USB" (output number: n+1) respectively. In case when the data inputted from USB terminal 13 are outputted to the unit 1 via TO HOST terminal 14, the mark MK3 is displayed at the intersection of USB unit 1 and TO HOST (output number: n+2) on the screen.

Additionally, on said editing image, based on said inputted input/output related data group, numbers of the units (shown between parenthesis in the figure) which output data to n MIDI input terminals 11-1~11-n are displayed. If no data exist to express unit number regarding the n MIDI input terminals 11~11-n, said unit number is not shown on the screen. As in the starting stage of operation, when any input/output related data are not registered in the interface unit 10, neither said mark MK nor the unit number corresponding to MIDI input terminals 11-1~11-n is displayed.

With the editing image displayed at the step 108, input/output related data are created and their editing is exercised at the step 110. In this process the user indicates an intersection of two broken lines parallel to X axis and Y axis by moving the cursor by means of a mouse controller or keyboard. If no mark was shown at the intersection before this indication process, the PC unit 31 simply displays a mark at the indicated intersection on the screen, and at the same time, the PC unit 31 writes the input/output related data corresponding to the mark in the input/output related data group which is temporarily memorized when inputted from said interface unit 10. Note that, in the initial stage, when any input/output related data group does not exist, said input/output related data corresponding to the displayed mark are simply written in the area where said input/output related data are to be memorized. On the contrary, if a mark was already displayed before said intersection indicating process, the PC unit 31, before writing the data, erases said mark on the screen, and at the same time, eliminates the input/output related data corresponding to the erased mark from the temporarily memorized input/output related data group. When unit numbers are to be indicated corresponding to n MIDI input terminals 11-1~11-n, the user moves the cursor to the right hand side of the selected ones among the displayed MIDI input terminals 11-1~11-n, and input the number of the unit by an PC input device such as keyboard etc., and at the same time, the data expressing the unit numbers inputted corresponding to said MIDI input terminals 11-1~11-n are registered in said temporarily memorized input/output related data group. On the other hand, if the user wants to eliminate any unit number given to n MIDI input terminals 11~11-n, the cursor should be moved to the position indicating the unit number to erase the displayed unit number by means of computer input devices such as keyboard. At the same time with the erasure of the unit number, the data expressing the unit number temporarily memorized in said input/output related data group are automatically erased.

After said step 110, the PC unit 31 at the step 112, sends, responding to the user's indication, all said newly established or renewed input/output related data corresponding to the displayed status of said editing image, to the interface unit 10 via USB cable. At the step 114, the execution of "the input/output related editing program" is completed.

In the interface unit 10, CPU 22 receives said input/output related data sent via USB terminal 13 and Buffer 24, and writes said input/output related data in the input/output related data area 21*b*. Input/output data relationship is thus defined with respect to all the terminals included in MIDI input terminals 11-1~11-n, MIDI output terminals 12-1~12-n, USB terminal 13 and TO HOST terminal 14.

By such editing of input/output relationship, even if the connection status between the interface unit 10 and various music units, computer unit etc. changes, it is easy to set a new data input/output relationship in accordance with the change. In this change, it is possible to define the input/output relationship in various ways, for example, to let the inputted data at one input terminal output from plural output terminals simultaneously or to let output the data inputted at plural input terminals output from only one output terminal. Generally, as the data transmission speed differs according to the transmission protocol, the number of units acceptable for a terminal differs. Especially, the number of units acceptable for TO HOST terminal 14 is less than the number of units acceptable for USB terminal. Consequently, in said editing process, at the moment when new establishment or modification of the input/output related data group is completed, if the number of a unit at the input side is too big to be treated at the output side, the number of unit can be abbreviated (in case of TO HOST transmission protocol, unit number is not necessarily required), or treated separately in another unit of the lower stream stage, by giving one defined unit number to plural units.

The following description explains how works the musical instrument performance system in which the setting up of the interface unit 10 is completed.

Figure 11:
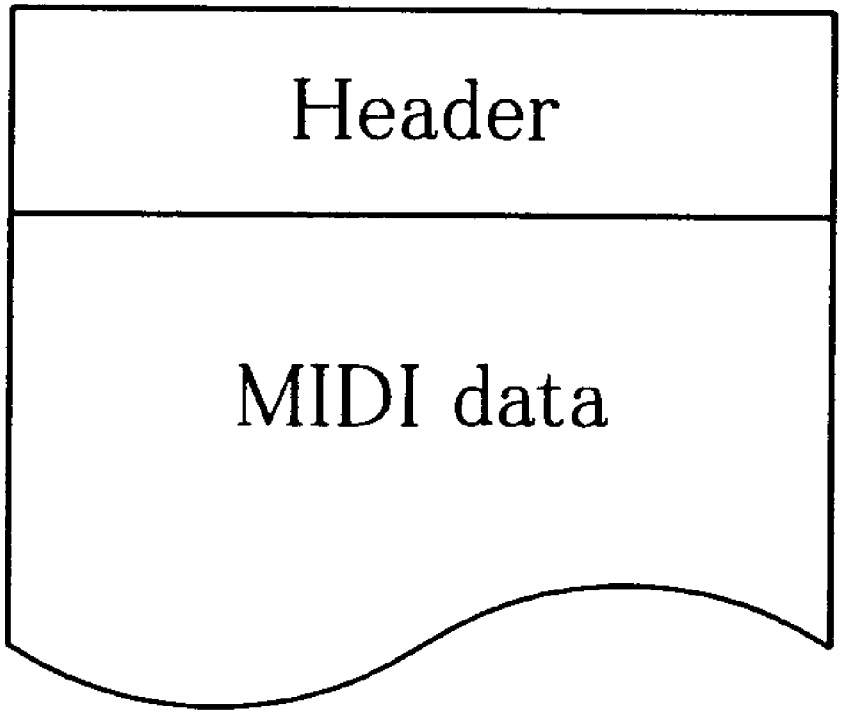
FIG. 11 is a format diagram of MIDI packet data.
Figure 12:
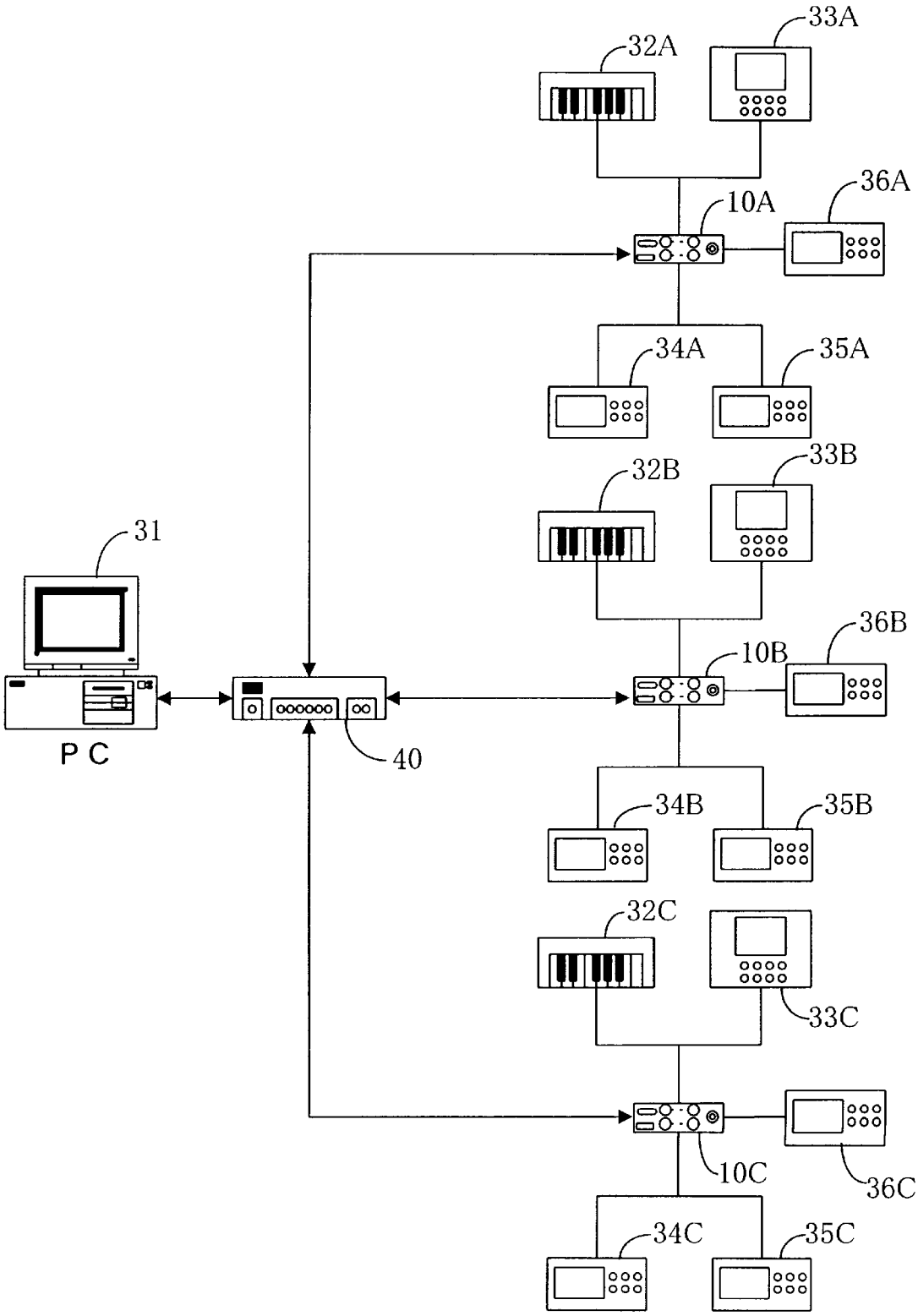
FIG. 12 shows a block diagram of another example of musical instrument performance system using the interface unit.

Firstly, the case when MIDI data are sent under USB transmission protocol from PC unit 31 to USB terminal 13 of the interface unit 10, is explained. In this case the input data is in a packet form with a header, as shown in FIG. 11 (hereinafter, such data in a packet form is called "MIDI packet data"). The header contains a unit number and necessary information regarding other packets.

In the interface unit 10, when said MIDI packet data are supplied to the USB terminal 13, CPU 22 begins to execute the "USB program" shown in FIG. 3 at the step 200, receives said MIDI packet data via Buffer 24 and temporarily memorizes them in RAM 23 at the step 202. Next, taking out both MIDI data and the unit number from the MIDI packet data at the step 204, CPU 22 determines the destination of output corresponding to the taken out unit number, at the step 206. In the determining process of the destination, CPU 22 refers the input/output related data group found in the input/output related data area 21*b*, designates USB terminal as input terminal, reads out the data corresponding to the taken out unit number, and to determine the terminal designated by the data as destination of output.

After the above-mentioned step 206, CPU 22 determines which should be the targeted destination, either one terminal of MIDI output terminals 12-1~12-n (output terminal number 1~n) or TO HOST terminal (output terminal number n+2), at the step 208. If anyone of MIDI output terminals 12-1~12-n is designated for output destination, the taken out MIDI data are outputted via Buffer 24 at the step 210, to the designated MIDI output terminal. Meanwhile, if the output destination is left to TO HOST terminal 14, the taken out MIDI data and the unit number are outputted via Buffer 24 at the step 212, to TO HOST terminal 14. The step 214 to be processed after the steps 210 and 212 completes execution of the "USB program".

The following paragraph explains the case when MIDI data are transmitted from an electronic musical instrument 32, a sequencers 33 etc. to one of MIDI input terminals 11-1~11-n in the interface unit 10 according to MIDI transmission protocol. In such case, MIDI data are not in the packet form, and no header is attached to them.

In the interface unit 10, responding to MIDI data arrival at anyone of MIDI input terminals 11-1~11-n, CPU 22 starts to execute "MIDI program" shown in FIG. 4 at the step 220, taking in said MIDI data via Buffer 24 to temporarily memorize in RAM 23, at the step 222. Next, CPU 22 refers input/output related data group in the input/output related data area 21*b*, reads out the data expressing an output terminal corresponding to one of MIDI input terminals 11-1~11-n to which said MIDI data are inputted, and determining the output terminal according to the designation of said data, at the step 224.

Following said step 224, the targeted output destination is selected among one of MIDI output terminals 12-1~12-n (output terminal number 1~n), USB terminal 13 (output terminal number n+1) and TO HOST terminal 14 (output terminal number n+2), at the step 226. If any-one of MIDI output terminals 12-1~12-n is designated for output destination terminal, the taken out MIDI data are outputted via Buffer 24 at the step 228 to the targeted MIDI output terminal designated by said data expressing the destination among MIDI output terminals 12-1~12-n.

On the other hand, if the output destination is left to either USB terminal 13 or TO HOST terminal 14, then CPU 22, at the step 230, refers input/output related data group in the Input/output related data area 21*b*, reads out the data expressing an output terminal corresponding to one of MIDI input terminals 11-1~11-n to which said MIDI data are inputted, and temporarily memorizes them in RAM 23. At the next step 232, said read out unit number and said taken MIDI data are outputted via Buffer 24 to either one of USB terminal 13 or TO HOST terminal 14 according to said designation of output destination. In this process, if the destination is USB terminal 13, MIDI packet data are established, by treating both unit number and MIDI data in packet form, to be outputted under USB transmission protocol. If the destination is TO HOST terminal 14, the treated MIDI packet data can be outputted under TO HOST transmission protocol, or alternatively only MIDI data themselves can be outputted under TO HOST transmission protocol. In the latter case, it is unnecessary to register a unit number by the process of the step 230. CPU 22 finalizes the execution of "MIDI program" at the step 234, after said step 228 and 232.

The following paragraph describes the case when MIDI data are sent from sound generation unit 36 etc. to TO HOST terminal 14 in the interface unit 10 under TO HOST transmission protocol. In such case, the input data can be either in the form of MIDI packet data as in the previously said USB transmission protocol case, or MIDI data themselves as in said MIDI transmission protocol case. It is noted that when the MIDI data under MIDI transmission protocol are treated in TO HOST transmission protocol, to put or not to put a unit number before MIDI data has no importance. If the data have no unit number, they are treated as if they had the same number as the precedent (last) case.

In the interface unit 10, when said MIDI packet data or MIDI data are supplied to TO HOST terminal 14, CPU 22 starts to execute "TO HOST program" in FIG. 5 at the step 240, takes in said MIDI packet data or MIDI data via Buffer 24, to temporarily memorize in RAM 23 at the step 242. At the next step 244, both MIDI data and unit numbers are taken out or established. In other words, if the inputted data are in a form of MIDI packet data, a unit number and MIDI data are separately taken out from MIDI packet data just as in said case of "USB program". And, if the inputted data are MIDI data themselves and a unit number is not given, said unit number, separately taken out and memorized in the inside register as renewed data, becomes the unit number to attach to said MIDI data. In case when a unit number is given to MIDI data, the MIDI data and the unit number are simply separated each other at this step.

After completing said step 244, the destination of the output is determined, at the step 246, according to said taken out or established unit number. In the process of determining the destination, the input/output related data group in the input/output related data area are referred at first, and then TO HOST terminal 14 is designated as input terminal. Simultaneously, the data expressing output terminal corresponding to said taken out or established unit number is read out, then the output terminal expressed by such data is designated as output destination.

In the step 248, the output destination is selected among one of MIDI output terminals 12-1~12-n (output terminal number: 1-n), USB terminal 13 (output terminal number: n+2), and TO HOST terminal 14 (output terminal number:

n+2). If the output destination is one of MIDI output terminals 12-1~12-n, said taken MIDI data are outputted via Buffer 24, at the step 250, to the MIDI output terminal designated by the data expressing said output terminal among MIDI output terminals 12-1~12-n.

Meanwhile, if the output destination is USB terminal 13 or TO HOST terminal 14, both said taken out or established unit number and said taken MIDI data are outputted via Buffer 24, at the step 252, to said designated destination USB terminal 13 or TO HOST terminal 14. When USB terminal 13 is the destination, MIDI packet data including the unit number as well as MIDI data are established, and then the MIDI packet data are outputted under USB transmission protocol. When TO HOST terminal 14 is the destination, MIDI packet data can be outputted under TO HOST transmission protocol as above-described, or MIDI data themselves can be outputted under TO HOST transmission protocol. In the latter case of outputting MIDI data themselves, it is unnecessary to establish a unit number at the process of step 244. After the steps 250 and 252, the execution of "TO HOST program" is completed at the step 254.

When MIDI data is outputted from MIDI output terminals 12-1~12-n to sound generation units 34, 35 etc., as stated in the above, the sound generation units 34, 35 etc. receive said MIDI data to generate musical sound signal according to the received MIDI data. In case when MIDI packet data or MIDI data are outputted from TO HOST terminal 14 to sound generation unit 36, the sound generation unit 36 executes the "received data processing program" integrated in it.

Figure 8:
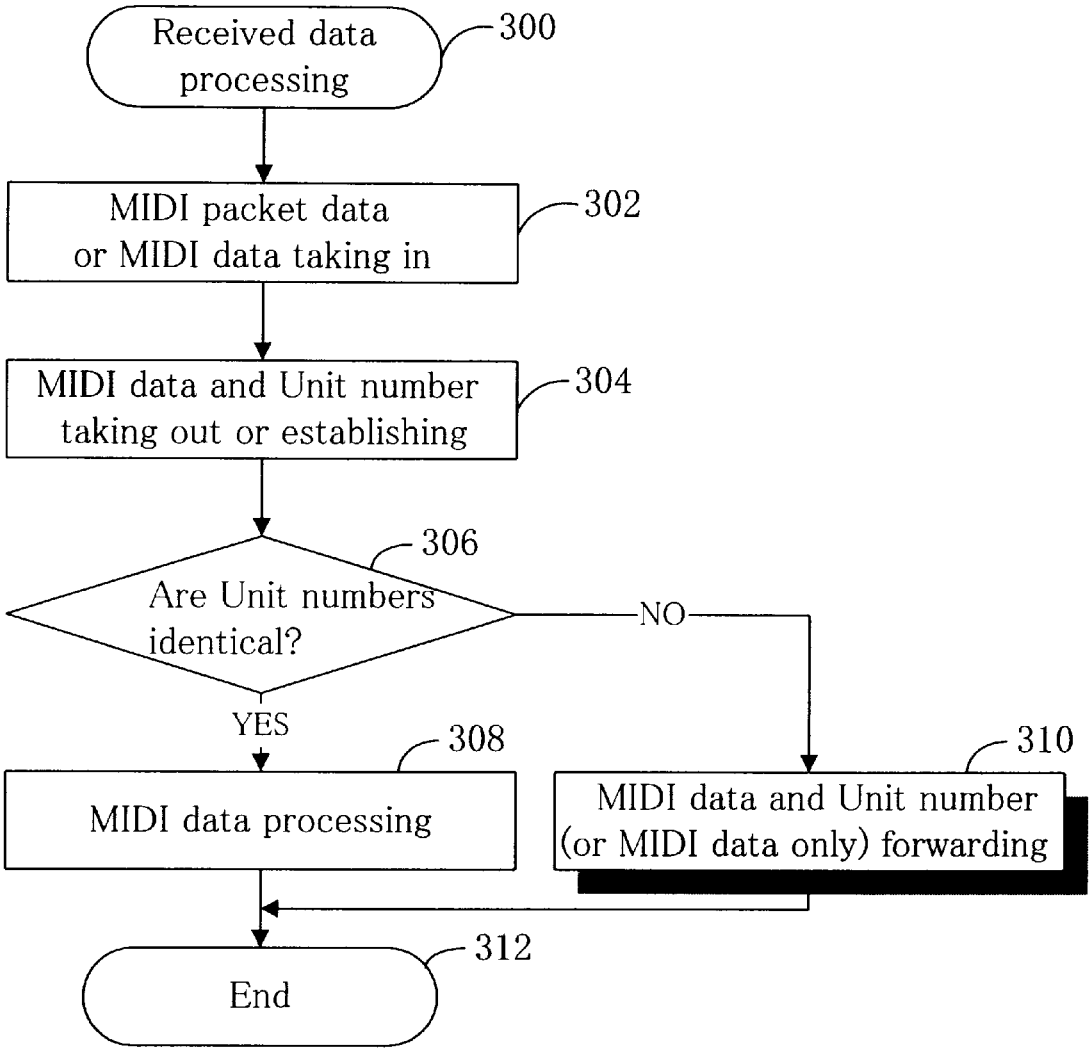
FIG. 8 is a flow chart of a program exercised in the sound generation system, in FIG. 7, in order to process received data.

The execution of the "received data processing program" starts at the step 300 in FIG. 8. The program takes in MIDI packet data or MIDI data at the steps 302 and 304, by similar processing as said steps 242 and 244 in FIG. 5, and takes out or establishes MIDI data and the unit number. Then, at the step 306, it is determined whether or not the taken out or established unit number is identical with the unit number of the sound generation unit 36. The unit number of the sound generation unit 36 must be defined beforehand when setting up the music performance system and registered in the sound registration unit 36 itself.

If said two unit numbers are found to be identical, with the determination saying "YES" at the step 306, MIDI data are treated at the step 308, and the execution of the "received data processing program" is completed at the step 312. This MIDI data treatment means making use of MIDI data in the sound generation unit 36, namely, for said sound generation unit to generate musical sound signal, according to said MIDI data, from the integrated musical signal producing circuit. If a sequencer or other devices equipped with TO HOST terminal is used instead of the sound generation unit 36, MIDI data treatment at said step 308 means storing MIDI data or exercising other process for MIDI data.

On the other hand, if said two unit numbers are found NOT identical, with the determination saying "NO" at the step 306, the program of the step 310 is executed and the execution of "received data processing program" is completed at the step 312. The procedure at the step 310 is to forward both MIDI data and unit number or only MIDI data to the designated sound generation units 37, 38 etc. disposed in the lower stream of the system. In this case the sound generation unit 36 includes in itself a micro-computer circuit working like the interface unit 10, which defines data input/output relationship by the editing program shown in FIG. 10. The sound generation unit executes program shown by the step 310 similar to the steps as the steps 246–252 in said "TO HOST program" in FIG. 5 to forward a part of said inputted data to sound generation units 37, 38 etc. in the following stream.

The next description is about another example of music performance system in which the interface unit of the present invention is utilized. In this example, the interface units 10A, 10B, 10C similar to said interface unit 10 are connected to PC unit 31 through the intermediary of Hub 40. The electronic musical instrument 32A, the sequencer 33A, the sound generation units 34A, 35A, and 36A are connected to the interface unit 10A, just as the connection in the previously described example of the interface unit 10. To the interface unit 10B, the electronic musical instrument 32B, the sequencer 33B, the sound generation units 34B. 35B, and 36B are connected, as said example of the interface unit 10. And also, to the interface unit 10C, the electronic musical instrument 32C, the sequencer 33C, the sound generation units 34C, 35C, and 36C are connected, as said same example of the interface unit 10.

The expansion of a musical instrument performance system becomes possible without difficulty, by introducing such Hub 40. Subsequently, more freely expanded musical instrument performance system can be constructed, if, in the execution of the "input/output related editing program" by PC unit 31, input/output related data are independently set for each one of the interface units 10A, 10B, 10C or if such input/output data are simultaneously set for each one of the interfaces 10A, 10B, 10C.

As clarified by the above explanation, it is realized in the described system, by introducing USB terminal 13 and TO HOST terminal 14 to the interface unit 10 in addition to MIDI input terminals 11-1~11-n and MIDI output terminals 12-1~12-n, and by executing "USB program" and "MIDI program" and "TO HOST program" shown in FIGS. 3–5, to input/output MIDI data under MIDI transmission protocol and to input/output MIDI data or MIDI packet data under USB transmission protocol and TO HOST transmission protocol. Accordingly, even when MIDI data is inputted from various music units such as electronic musical instrument 32, sequencer 33 and, at the same time, a large quantity of data are inputted from PC unit 31 via USB terminal, MIDI data can be outputted to various music units such as sound generation units 34, 35, and at the same time, the data can be outputted to other interface units, various music units, PC unit etc., via TO HOST terminal 14, and moreover, the data can be outputted to the succeeding various music units in lower stream. Thus, with said example of embodiment, the advantage of handling a large number of various music units comes to be realized at its maximum, by transmitting each other a large number of performance data efficiently among various music units. As TO HOST transmission protocol is used in many existing music units, the adoption of the TO HOST transmission protocol enables more effective usage of existing music units.

Furthermore, through the execution of "input/output related editing program" in FIG. 8 by PC unit 31, the input/output conditions can arbitrarily define one selected terminal among MIDI output terminals 12-1~12-n, USB terminal 13 and TO HOST terminal 14, from which MIDI data or MIDI packet data inputted via MIDI input terminal 11~11-n, USB terminal and TO HOST terminal, is outputted. For this reason, as MIDI data can be freely forwarded (exchanged) via the interface unit 10, the advantage of utilization of a large number of music units connected to the interface unit 10 becomes its maximum.

Moreover, if the music performance system is modified by any addition or elimination of units such as electronic musical instrument, sound generation unit, the interface unit etc., new input/output related data can be defined according to said system modification, through PC unit without changing "Input/output related editing program", which makes it easy to modify the music performance system.

This "input/output related editing program" exercises; inputting of the data expressing input/output related terminals from the interface unit at the step 102 in FIG. 9, editing of input/output relationship based on said data at the steps 104–110, and modifying memorized data in the input/output related data area 21*b* in the interface unit 10 by outputting the edited data at the step 112. Consequently, even when input/output related terminals of the interface unit 10 are changed in their number and their type, said "input/output related editing program" can be used without any modification except the size of input/output related data area 21*b*. This makes it possible to use said program for various types of interface units.

Further, by storing such "input/output related editing program" in the media such as flexible disk, compact disk, hard disk, it is possible to install said program in PC unit 31, which makes it possible to set up said input/output conditions easily and with ample freedom.

In the above-described embodiments, three following types of means are adopted in the interface unit 10: (1) MIDI input means and output means by which the data input /output is possible under MIDI transmission protocol (corresponding to MIDI input terminals 11-1~11-n, and MIDI output terminals 12-1~12-n, and a part of "MIDI program", "USB program" and "TO HOST programs"), (2) USB input/output means by which the data input/output is possible under USB transmission protocol (corresponding to USB terminal 13 and a part of "MIDI program", "USB program" and "TO HOST program"), and (3) TO HOST input/output means by which the data input/output is possible under TO HOST transmission protocol (corresponding to TO HOST terminal 14 and a part of "MIDI program", "USB program" and "TO HOST program"). It is yet possible to set up, in the interface unit 10, plural units of either one of USB input/output means or TO HOST input/output means. It is preferred, however, to set up both USB input/output means and TO HOST input/output means functioning under two other sorts of transmission protocol different than MIDI transmission protocol, just as in the above-described embodiment. In this case too, it is also possible to provide in the interface unit 10 plural units of either one or both of USB input/output means and TO HOST input/output means. It is also possible to use in the interface unit 10 different input/output means functioning under more than three sorts of transmission protocol which in all are different from MIDI transmission protocol. In such case also, it is possible to provide plural input/output means functioning under one or plural sorts of transmission protocol.

As other sorts of transmission protocol than MIDI transmission protocol, IEEE1394 transmission protocol or still other transmission protocols can replace either one or both of said USB protocol and TO HOST protocol. A protocol by which data are transmitted in parallel, being different from the transmission protocols for serial data transmission such as USB transmission protocol, TO HOST transmission protocol, IEEE1394 protocol, maybe also adopted. These cases can be realized by providing the interface unit 10 with adequate terminals according to adopted transmission protocols as well as proper program which enables data sending and receiving under each one of the adopted protocols.

In the above-described embodiment the input/output related group in the interface 10 is defined by PC unit 31. However it is also possible to set up the input/output related data by the interface unit itself, by integrating data input devices such as keyboard, mouse controller and display unit in the interface unit 10 itself, or by connecting said input devices and display unit to the interface unit 10, and also by integrating "input/output related editing program" shown in FIG. 9 in the interface unit 10, or by installing the program in the interface unit 10. It is also possible to realize the function by another type of embodiment. For instance, providing the interface unit 10 with a driver program enabling it to read out the input/output related data stored in an exterior storage devices such as flexible disk, compact disk, the data being defined by other PC unit in the storage device. The stored input/output related data is written in the input/output related data area 21*b* of the interface unit 10, via said driver program.

In the embodiments above-described, the interface unit is in a form of independent unit, but the interface unit 10 can be provided also by being integrated in other different devices such as PC unit 31, electronic musical instrument 32, sequencer 33, sound generation units 34~38.

Further, the interface unit 10 has a power supplying terminal 15 to function the interface unit 10, in the embodiments already described. Among recently introduced USB cables or IEEE1394 cables, there are examples which can supply electric power by such cables. However, with such cables, rapid consumption of the electric battery in PC unit 31 may happen when the PC unit adopts a storage type battery. It is therefore recommended to utilize the electric power supplied from said power supplying terminal 15 in the interface unit 10 in order to avoid such rapid battery consumption. For this sake, when electric power is supplied to the power supplying terminal 15 via power cable, it is recommended to set up the interface unit to utilize in priority the electronic power supplied via the power supplying terminal 15. For the moment when electric power is not supplied via the power supplying terminal 15, it is then recommended to set up beforehand whether or not the interface unit 10 utilizes the electric power supplied via USB cable, IEEE1394 cable etc. As electric power can be supplied via the power supplying terminal 15, data transmission becomes possible even when using only such cables as TO HOST cable, MIDI cable with which power supply is not possible.

This invention can be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An interface unit for inputting and outputting data comprising:

MIDI input terminals through which data can be inputted under MIDI transmission protocol;

MIDI output terminals through which data can be outputted under MIDI transmission protocol;

first terminal through which MIDI data can be inputted and outputted under first transmission protocol different from MIDI transmission protocol; and second terminal through which MIDI data can be inputted and outputted under transmission protocol different from both MIDI transmission protocol and said first transmission protocol.

2. The interface unit according to claim 1, wherein the data are transmitted through said first terminal under USB transmission protocol and through said second terminals under TO HOST transmission protocol.

3. An interface unit for inputting and outputting data comprising:

MIDI input terminals through which data can be inputted under MIDI transmission protocol;

MIDI output terminals through which data can be outputted under MIDI transmission protocol;

first terminal through which MIDI data can be inputted and outputted under first transmission protocol different from MIDI transmission protocol;

second terminals through which MIDI data can be inputted and outputted under transmission protocol different from both MIDI transmission protocol and said first transmission protocol; and a processor connected to said MIDI input terminals, said MIDI output terminals, said first terminal, and said second terminal, the processor adapted to input and output data through said terminals.

4. The interface unit according to claim 3, wherein said processor adapted to input and output data through said terminals in accordance with relationship of inputting and outputting among said MIDI input terminals, said MIDI output terminals, said first terminal, and said second terminal, the relationship being defined by conditions, which can be altered to determine which terminal, said MIDI input terminals, said MIDI output terminals, said first terminal, or said second terminal, should be selected to output the data inputted through said terminals.

5. The interface unit according to claim 4, wherein said interface unit being connected to another processor adapted to determine said conditions.

6. The interface unit according to claim 3, wherein the data are transmitted through said first terminal under USB transmission protocol and through said second terminals under TO HOST transmission protocol.

7. A method for controlling inputting and outputting data through an interface unit, having MIDI input terminals, MIDI output terminals, first and second terminals comprising steps of:

determining relationship of inputting and outputting among said MIDI input terminals, said MIDI output terminals, said first terminal, and said second terminal, in accordance with the conditions, which can be altered to determine which terminal, said input terminals, said MIDI output terminals, said first terminal, or said second terminal, should be selected to output the data inputted through said terminals; and inputting MIDI data through said MIDI input terminals under MIDI transmission protocol, outputting MIDI data through said MIDI output terminals under MIDI transmission protocol, inputting or outputting MIDI data through said first terminal under first transmission protocol different from MIDI transmission protocol, and inputting or outputting MIDI data through said second terminal under second transmission protocol different from both MIDI transmission protocol and said first transmission protocol, in accordance with said relationship determined in said determining step.

8. The method according to claim 7, wherein said first transmission protocol is USB transmission protocol, and said second transmission protocol is TO HOST transmission protocol.

9. The method according to claim 7, said determining step further comprising the steps of:

displaying editing image showing input terminals along with one axis and output terminals along with the other axis perpendicular to said axis; and displaying relationship of said input terminals and said output terminals designated on said editing image.

10. A machine readable medium containing instructions for causing said machine to perform a method for controlling inputting and outputting MIDI data through an interface unit having MIDI input terminals through which MIDI data can be inputted under MIDI transmission protocol, MIDI output terminals through which MIDI data can be outputted under MIDI transmission protocol, first terminal through which MIDI data can be inputted and outputted under transmission protocol different from MIDI transmission protocol, and second terminal through which data can be inputted and outputted under transmission protocol different from both MIDI transmission protocol and said first transmission protocol, said method comprising:

determining relationship of inputting and outputting among said MIDI input terminals, said MIDI output terminals, said first terminal, and said second terminal, in accordance with conditions, which can be altered to determine which terminal, said MIDI input terminals, or said second terminal, should be selected to output the data inputted through said terminals.

11. The machine readable medium according to claim 10, said determining step further comprising the steps of:

displaying editing image showing input terminals along with one axis and output terminals along with the other axis perpendicular to said axis; and displaying relationship of said input terminals and said output terminals designated on said editing image.

* * * * *